US007300395B2

(12) United States Patent
Sleight et al.

(10) Patent No.: US 7,300,395 B2
(45) Date of Patent: Nov. 27, 2007

(54) METHOD FOR MANUFACTURING A BAG

(75) Inventors: Greg W. Sleight, Willowbrook, IL (US); Amit Shah, Willowbrook, IL (US); John Rusnak, Willowbrook, IL (US); Jack Melvan, Willowbrook, IL (US); Timonthy LaRocque, Willowbrook, IL (US)

(73) Assignee: The Glad Products Company, Oakland, CA (US)

( * ) Notice: Subject to any disclaimer, the term of this patent is extended or adjusted under 35 U.S.C. 154(b) by 29 days.

(21) Appl. No.: 11/223,612

(22) Filed: Sep. 9, 2005

(65) Prior Publication Data

US 2006/0009339 A1 Jan. 12, 2006

Related U.S. Application Data

(62) Division of application No. 10/293,028, filed on Nov. 13, 2002, now Pat. No. 6,994,469.

(60) Provisional application No. 60/351,936, filed on Jan. 25, 2002.

(51) Int. Cl.
*B31B 1/90* (2006.01)

(52) U.S. Cl. ..... 493/215; 493/210; 493/928; 383/33; 383/118; 383/49

(58) Field of Classification Search ..... 493/210, 493/918, 213–215, 928; 383/33, 118, 49
See application file for complete search history.

(56) References Cited

U.S. PATENT DOCUMENTS

| | | | | |
|---|---|---|---|---|
| 2,631,629 | A | 3/1953 | Lee | |
| 3,311,288 | A | 3/1967 | Lemelson | |
| 3,639,917 | A | 2/1972 | Althouse | |
| 3,733,024 | A | 5/1973 | Bolling, Jr. et al. | |
| 3,819,401 | A | 6/1974 | Massengale et al. | |
| 3,912,565 | A | 10/1975 | Koch et al. | |
| RE28,688 | E | 1/1976 | Cook | |
| 3,974,960 | A | 8/1976 | Mitchell | |
| 4,314,558 | A | 2/1982 | Korpman | |
| 4,509,570 | A | 4/1985 | Eby et al. | |
| 4,515,595 | A | 5/1985 | Kievit et al. | |
| 4,527,990 | A | 7/1985 | Sigl | |
| 4,563,185 | A * | 1/1986 | Reiter | 604/385.3 |
| 4,582,550 | A | 4/1986 | Sigl | |
| 4,738,478 | A | 4/1988 | Bean, Jr. | |

(Continued)

FOREIGN PATENT DOCUMENTS

| | | |
|---|---|---|
| GB | 547177 | 8/1942 |
| GB | 2160473 | 12/1985 |
| WO | 03/39005 | 7/2000 |

*Primary Examiner*—Hemant M. Desai
(74) *Attorney, Agent, or Firm*—Thomas C. Feix; Alok Goel

(57) ABSTRACT

A retaining element for use with elastic sheet material is disclosed. In one form, the sheet material can be provided as a bag (100) having first and second side walls (102, 104). The retaining element can be in the form of an elastic strip attached to one of the side walls. The retaining strip (120) can comprise a heat-unstable activatable material such that it can be applied to the bag in a deadened condition wherein the strip is set and subsequently heated to transition to an activated condition wherein the retaining element is elasticized to provide an elasticized article which can have a shirred appearance. The retaining element can have various configurations and can be activated by various methods.

16 Claims, 3 Drawing Sheets

U.S. PATENT DOCUMENTS 4,747,701 A 5/1988 Perkins
4,808,252 A 2/1989 Lash
4,813,793 A 3/1989 Belmont et al.
4,813,794 A 3/1989 Herrington
4,842,421 A * 6/1989 Bullard et al. ..... 383/61.4
4,861,635 A 8/1989 Carpenter et al.
4,906,108 A 3/1990 Herrington et al.
4,908,247 A 3/1990 Baird et al.
4,913,560 A 4/1990 Herrington
4,989,994 A 2/1991 Gelbard
5,000,325 A 3/1991 D'Elia
5,040,902 A 8/1991 Eaton et al.
5,043,383 A 8/1991 Eaton et al.
5,120,138 A 6/1992 Midgley et al.
5,404,999 A 4/1995 Bednar
6,022,144 A * 2/2000 Hausslein ..... 383/33
6,059,458 A 5/2000 Belias et al.
6,164,824 A 12/2000 McClew et al.
6,220,753 B1 * 4/2001 Metzger ..... 383/33
6,419,798 B1 7/2002 Topolkaraev et al.
6,467,957 B2 10/2002 Yeager
6,561,696 B1 * 5/2003 Rusnak et al. ..... 383/75
6,585,415 B2 * 7/2003 Malaspina ..... 383/75
6,921,202 B2 * 7/2005 Raterman ..... 383/33
7,077,796 B2 * 7/2006 Rusnak et al. ..... 493/215

* cited by examiner 300
302
304
306
308
310
312
314
320
321
200
210
230
232
130
150
152
154
102
104
106
108
110
112
120
222
240
241

METHOD FOR MANUFACTURING A BAG

CROSS-REFERENCE TO RELATED PATENT APPLICATIONS

This patent application is a division of U.S. application Ser. No. 10/293,028 filed on Nov. 13, 2002, now U.S. Pat. No. 6,994,469 issued on Feb. 7, 2006, which claims the benefit of U.S. Provisional Patent Application No. 60/351,936, filed Jan. 25, 2002, and entitled "Shirred Elastic Sheet Material," which is incorporated in its entirety herein by this reference.

FIELD OF THE INVENTION

The present invention is directed in general to a shirred elastic sheet material and a method for producing the same, and more particularly to a sheet material in the form of a bag. The invention has particular utility in the high-speed continuous production of elasticized plastic liner bags for trashcans, for example, wherein the elastic properties enable the liner bag to be secured in place within a trashcan.

BACKGROUND OF THE INVENTION

Plastic trash bags are produced and sold on an extensive scale in a variety of shapes and sizes. The vast majority of these bags are made of polyethylene film. The bags in general include sidewalls that are often joined by one or more seams, a closed lower bottom end, and an open upper end. The trash bag can serve as a liner for a trashcan. Conventionally, an upper edge of the bag, which defines the open end, is rolled over an upper lip of the trashcan to position the bag in an open position and to secure the bag to the trashcan. It can be difficult to maintain the bag in the open position and in a secured relationship with respect to the top of the trashcan when the bag is loaded with trash.

The use of elastic means for securing the open end of a liner bag to the top edge of a trashcan is generally known. It is desirable for such an elastic top bag to provide adequate "grip" to the can to prevent the bag from falling into the can when loaded with trash. As a competing consideration, however, because the cost of the elastic component typically far outweighs the cost of the liner bag material, it is also desirable to limit the amount of elastic used to only that which is necessary to provide adequate grip. Furthermore, since most trash bags are packaged in rolls or in a highly folded condition, it is desirable that the incorporation of elastic means on a liner bag does not hinder conventional packaging techniques.

An attachment method used in the incontinence industry involves the intermittent bonding or "stitch attachment" of heat-activated elastic film material onto a substrate such that between every two bond regions there is a discernable unattached length of the heat activated elastic film material. The bonds are created by heat sealing or adhesive. This type of basic pattern can be reproduced to make spaced intervals or "stitches" of attached and unattached sections. Once the garment has been processed and activated (i.e., subjected to heat), the unattached portions of the elastic material shrink to provide a shirred and elastic garment. This attachment method can also be applied to making elastic top trash bags, such as shown in U.S. Pat. No. 5,120,138 to Midgley and International PCT Patent Application No. WO 00/39005 to Marchal.

Garment and diaper manufacturers typically apply pre-cut strips of the heat-activated elastic film material onto an article in a direction transverse to the direction of the article substrate in a production situation. This intermittent stitch attachment method has been applied to making elastic top trash bags. Such an attachment technique, however, can be impractical in the case of plastic bags produced by a conventional high-speed continuous bag machine because it involves the intermittent bonding of individual strip lengths of the elastic to discrete sections of a continuously moving web, making consistent alignment of the individual elastic strips with respect to the leading and trailing edges of successive bag sections of the moving web difficult to achieve. This problem is especially evident as the speed of the web varies during ramp up and ramp down operations of the bag production machinery.

Accordingly, there is a need in the art for an improved method of continuous production of elasticized liner bags which is cost effective, enables high speed operation, and is easily adaptable to existing bag machinery.

BRIEF SUMMARY OF THE INVENTION

The present invention is directed at solving some of the problems with the prior art by providing a simple means that will serve to keep a bag open in use, which is advantageous in terms of cost, packaging and manufacture.

In one aspect of the invention, a bag is provided which includes first and second side walls joined by first and second seams, a closed bottom end, and an open top end. A retaining element in the form of an elastic strip can be applied to one or both of the side walls adjacent the top end.

A machine direction oriented film can be provided for the retaining element which has a heat unstable condition in which the material is "dead," or set, and a heat stable condition in which the material is "activated," or elastic. The elastomeric film can be applied as a retaining element in the form of a strip to a bag to produce an elastic top which can help to maintain the bag around a trash can and help prevent the bag from falling into the trash can. The elastomeric film can be applied to the top of the bag by being heat sealed or otherwise attached to the side wall of the bag.

The heat shrinkable elastic material can be applied to a polyethylene web assembly in a high-speed production situation. The elastic material can be attached onto the polyethylene web in its heat unstable state. The material can be activated to its heat stable state at a later point in the process to yield an elastic top and shirred trash bag, for example.

Advantageously, the elastic top bag can be easily processed and activated. The elastic retaining strip can be applied to a bag in a "dead" form and then "activated" after manufacture and packaging of the bag is complete. The elastic retaining strip can be-activated by directing heat to the strip and/or generating heat on the heat-activated elastomeric strip so that it may shrink. Attaching the elastic strip in a deadened condition and subsequently activating the retaining element to provide an elastic top can allow for the manufacture of elasticized articles in a high speed, continuous, automated manner.

The invention can allow for the ready-application of elastic across the entire width of the bag. A portion of the retaining element can be continuously attached across the entire width of the bag. This method of attachment allows for the unattached or unbonded portion of the elastic strip to shrink when the strip is activated. As the unattached portion of the elastic strip shrinks, it displaces the body of the bag, thereby causing the bunching or gathering of the bag and producing an elastic bag.

Articles formed by the method of the present inventions can have at least portions thereof which are shirred or gathered, as in the case of shirred openings in food bags, dish covers, trash bags, and the like.

The invention can provide an efficient and economical method of manufacturing an elastic top bag. The elastic retaining element can be applied to a flap tie bag, a gusseted bag, a flat top bag, or a draw tape bag which includes a cinchable drawstring. The present method may also be used in a variety of other fields and on other products.

As employed in the description and claims of the present invention, the terminology "sheet material" and "sheet sections" can comprise thermoplastic materials suitable for the high-speed production of disposer and food storage bags including, but not limited to, high density polyethylene, low density polyethylene, linear low density polyethylene and/or combinations thereof.

Features of the present invention will become apparent to one of ordinary skill in the art upon reading the detailed description, in conjunction with the accompanying drawings, provided herein.

DETAILED DESCRIPTION OF EMBODIMENTS OF THE INVENTION

Figure 1:
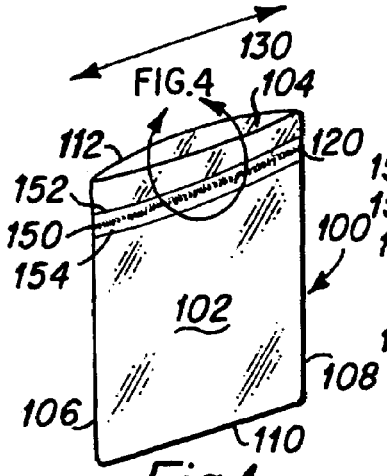
FIG. 1 is a perspective view of a section of plastic sheet material in the form of a bag having a shrinkable, heat-activated retaining element in the form of an elastic strip mounted thereto in accordance with the present invention.

Turning now to the drawings, there is shown in FIG. 1 an illustrative section of sheet material in the form of a bag 100 which includes a first side wall 102 and a second side wall 104. The first side wall 102 may be joined to the second side wall 104 at a first seam 106 and a second seam 108. The first and second sidewalls 102, 104 define a closed bottom end 110 and an open top end 112. The bottom 110 can be joined by a heat seal or a fold in a U-folded or J-folded sheet material.

At approximately about one-half inch to about five inches from the open top end 112 on the first side wall 102, there is attached a retaining element in the form of a strip 120 of elastic material which may extend the entire width of the bag 100 between the first and second seams 106, 108, measured along an X-axis 130. In one embodiment, the elastic strip 120 is a heat-unstable film which can be applied to the first side wall 102 in a "dead" condition wherein the strip is set. The strip 120 can then be activated by heating after the manufacture and packaging of the bag is complete, for example, to an activated condition wherein the strip is elasticized such that it is resiliently stretchable. Providing the heat-unstable elastic strip 120 in a deadened form can allow for the manufacture of elasticized articles in a high speed, continuous, automated manner.

Figure 2:
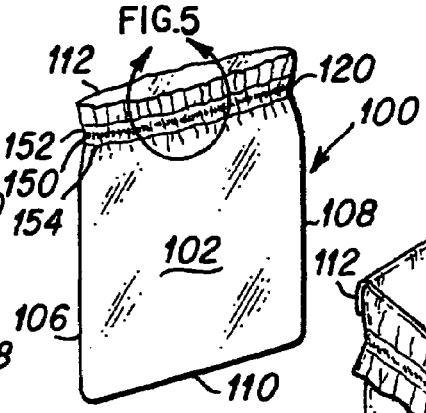
FIG. 2 is a perspective view similar to FIG. 1, illustrating the bag after the elastic strip has been activated.

Referring to FIG. 2, the elastic strip 120 has been activated by heating the bag 100. The elastic strip 120 has been activated such that it is in an elastic condition. The first side wall 102 can shrink in width in response to the elastic strip being activated, thereby reducing the size of the open end 112 of the bag 100 to provide a shirred appearance to the bag.

Figure 3:
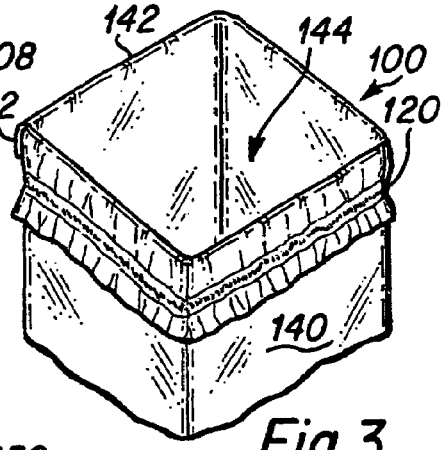
FIG. 3 is a perspective view of the bag mounted to a trashcan with an elastic strip of the trash bag being used to secure the bag to the trashcan.

Referring to FIG. 3, the bag 100 is shown secured to a trashcan 140. The trash bag 100 is shown with the top end 112 wrapped around an upper lip 142 of the trashcan 140 with the remainder of the bag 100 being inserted within a cavity 144 of the trashcan. With the elastic strip 120 activated to an elastic condition, the open top is elasticized such that it can move from a constricted position, as shown in FIG. 2, to a stretched position, as shown in FIG. 3, for securing the open end 112 of the bag 100 to the trashcan 140. The elastic strip 120 can stretch to allow the top end to move to the stretched position and, in turn, provide a gripping force to retain the bag in place with respect to the trashcan 140.

Figure 4:
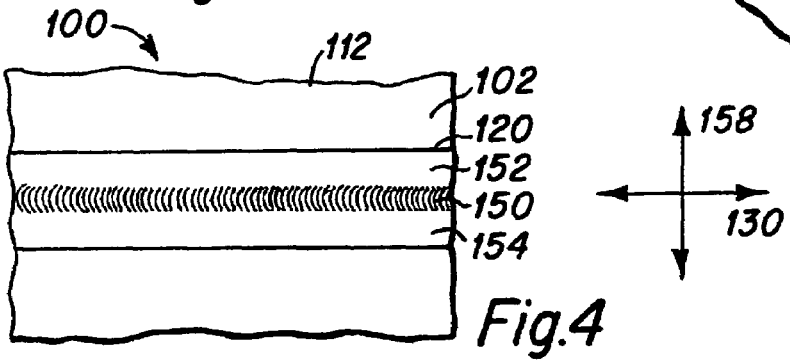
FIG. 4 is an enlarged, detail view of the elasticized region encircled by arrows in FIG. 1.
Figure 6:
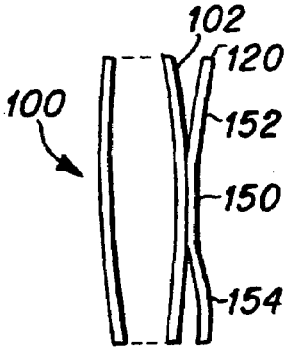
FIG. 6 is a cross-sectional view taken along line 6-6 in FIG. 5.
Figure 5:
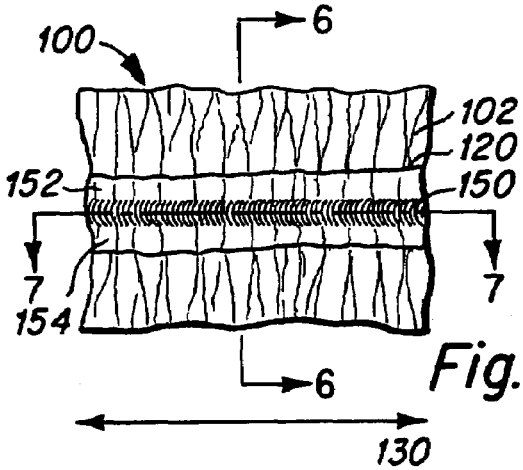
FIG. 5 is an enlarged, detail view of the elasticized region encircled by arrows in FIG. 2.
Figure 7:
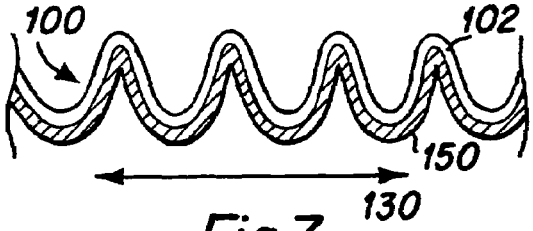
FIG. 7 is a cross-sectional view taken along the line 7-7 of FIG. 5.

Referring to FIGS. 4-6, the elastic strip 120 includes an attachment portion in the form of an attached region 150 which can be heat-sealed to the first side wall 102. The attached region 150 may extend in a continuous seal across the entire width of the bag 100 along the X-axis 130, extending between the first and second seams 106, 108, as shown in FIG. 1. Referring to FIG. 7, the attached region 150 can be continuously secured to the first side wall 102 of the bag 100 by a heat sealing process, for example. There are a number of different sealing methods which can be utilized to mount the elastomeric retaining strip to the bag. The elastic strip 120 can be secured to the first sidewall using other techniques, as well.

Referring to FIGS. 4-6, the elastic strip 120 may include first and second unattached regions 152, 154 with the attached region 150 disposed between the first and second unattached regions 152, 154. The unattached regions 152, 154 are integral with the attached region 150. The unattached regions 152, 154 are not attached to the first side wall of the bag, as shown in FIG. 6. The unattached regions 152, 154 may extend the full width of the bag 100 along the X-axis 130, extending between the first and second seams 106, 108, as shown in FIG. 1.

Referring to FIG. 4, the regions 150, 152, 154 of the elastic strip 120 are approximately the same height, measured along a Y-axis 158, as each other. The Y-axis 158 is perpendicular to the X-axis 130. For example, the elastic strip 120 is approximately ¾ of an inch high with the attached region 150 being approximately ¼ of an inch high. The remainder of the elastic strip is comprised of the unattached regions 152, 154, each being approximately ¼ of an inch high. The first unattached region 152 is disposed adjacent the top end 112 above the attached region 150. The second unattached region 154 is disposed below the attached region 150.

The attached region 150 can have a surface area which is less than or equal to the combined surface areas of the first and second unattached regions of the elastic strip 120 according to the following expression:

$$(A_s/A_u) \leq 1,$$

where $A_s$ is the surface area of the attached region 150 and $A_u$ is the combined surface area of the first and second unattached regions 152, 154. The relationship expressed above can apply to an elastic strip with a height between about one-half inch to about one inch, for example. In other embodiments, with different tape materials, the relationship between the surface area of the attached region and the surface area of the unattached portion of the retaining strip can be varied.

Figure 8:
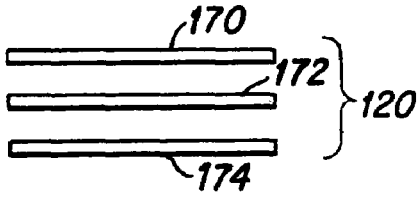
FIG. 8 is an enlarged, exploded view of a heat-activated elastic tape construction useful in connection with embodiments of the present invention.

Referring to FIG. 8, the elastic retaining strip 120 can be made of three layers 170, 172, 174. The first layer 170 can be a soft sealable copolymer, with ethylene-vinyl acetate copolymer (EVA) being preferred. The second layer 172 can be a rubber/elastomeric material, with ethylene propylene diene monomer rubber (EPDM) being preferred. The third layer 174 can be EVA. The EVA layers 170, 174 can be used to facilitate attachment of the retaining strip 120 to the side wall. The retaining strip 120 can comprise the material marketed by Tredegar Film Products of Richmond, Va. under the name COX-702.

The three-layer construction can be oriented so as to cause a set of the material that can later be activated by the application of heat. The EPDM 172 layer is urged to shrink along its length when heated to temperatures within its shrink curve of between about 100 to about 150° F., with 140° F. being the preferred temperature, where maximum shrinking takes place, ("the activation temperature"). Thus, the EPDM layer 172 has at least two states. The first state is the "deadened" or unactivated state wherein the EPDM layer 172 has a certain length. The EPDM layer 172 can remain in the unactivated state until the EPDM layer 172 is heated above the activation temperature. When the EPDM layer 172 is heated above the activation temperature, the EPDM layer achieves a second state, the activated state, wherein the layer is urged to shrink along its length.

The manufacture of heat-unstable film for use as an elastic strip is well known in the art as demonstrated by the manufacturing methods and heat-unstable films disclosed in U.S. Pat. Nos. 4,820,590; 3,85,769; 5,182,069; and 4,714,735, which are incorporated herein in their entireties by this reference.

Other suitable materials for the retaining tape can be used in other embodiments. Additionally various blends and grades of the general types of materials indicated above, such as EMA, EVA, Index, ULDPE below 0.900 g/cc, etc, for example, can be used with good results. In a further embodiment, such blends as indicated above may optionally include the addition of small quantities of a block copolymer thermoplastic elastomer including, but not limited to, styrene ethylene butadiene styrene copolymer (SEBS), SBS copolymer, EPDM, and/or blends thereof, for improved elasticity.

Polymeric receptive materials, such as EVOH, Carilon polyketone (a product from Shell), and thermoplastic polyurethanes (TPUs), and/or ethylene carbon monoxide copolymers such as Elvaloy (a trademark of The Dupont Company) for example, can also be used to facilitate activation by microwave heating as discussed subsequently herein.

Figures 9, 10, 11:
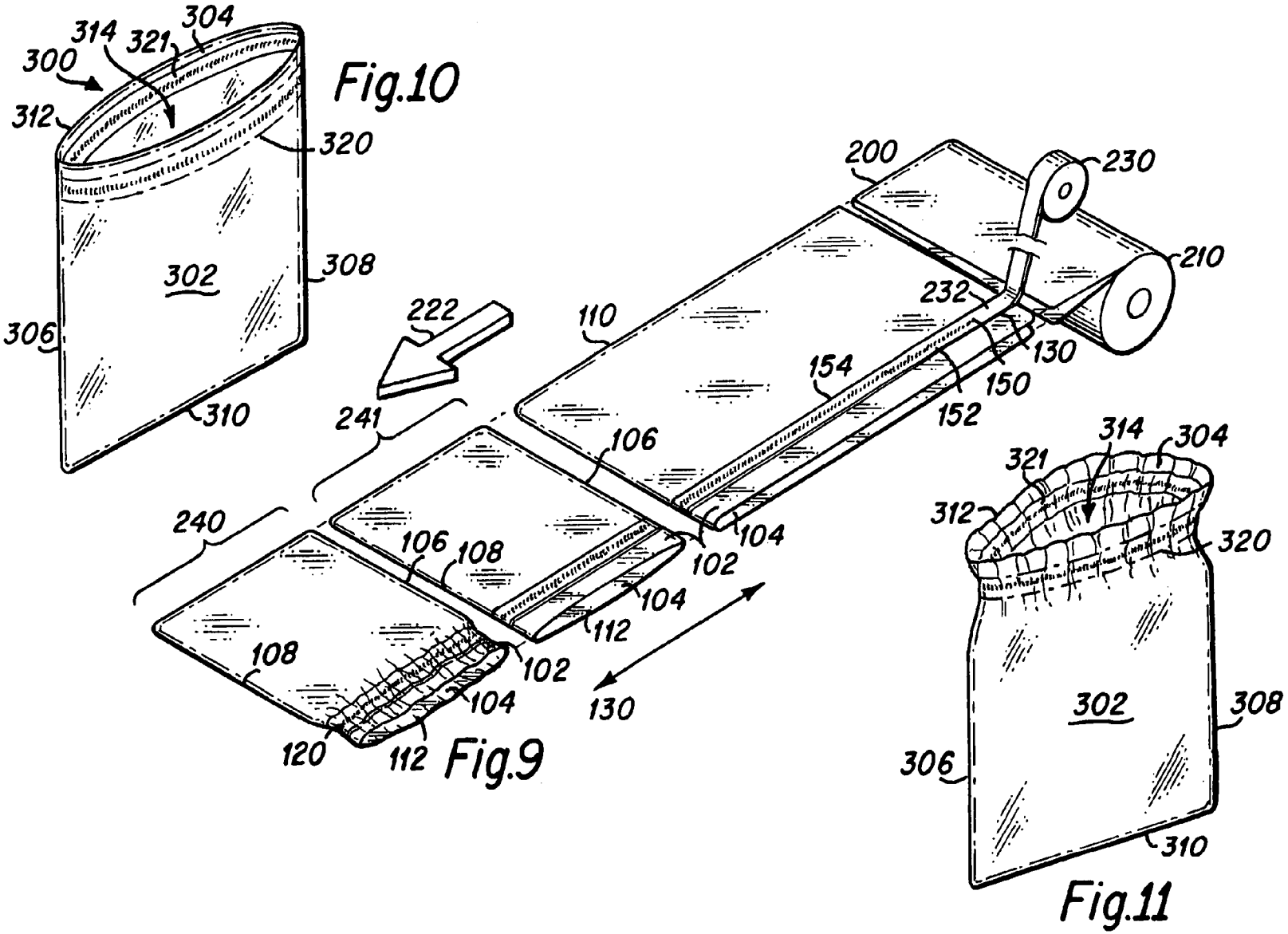
FIG. 9 is a perspective view illustrating the fabrication of elastic top plastic bags from a continuous web of plastic in accordance with the present invention.
FIG. 10 is a perspective view of another embodiment of an elastic top bag construction in which an activatable elastic retaining strip is attached to both first and second side walls of the bag.
FIG. 11 is a perspective view similar to FIG. 10, illustrating the elastic material in an activated condition.

Referring to FIG. 9, an embodiment of a method of manufacturing a bag including a retaining element according to the present invention is shown. A bag assembly 200 can be dispensed from a roll 210 of polyethylene plastic material, for example. The roll 210 of polyethylene can be oriented in the direction of extrusion indicated by the arrow 222. The polyethylene plastic can be configured into a sheet which is folded such that it has a generally U-shaped cross-section. The folded sheet defines continuous first and second side walls 102, 104 and the closed bottom end 110. The folded sheet can be dispensed from the roll 210 to provide the bag assembly 200. A roll 230 of retaining element ribbon can be provided. Retaining element ribbon 232 can be dispensed from the roll 230 and applied to the bag assembly 200. The retaining element ribbon 232 can be continuously attached to the bag assembly 200 with a continuous seal to provide the attached region 150, and thereby define the first and second unattached regions 152, 154. The retaining element ribbon 232 can be provided in a deadened condition such that the ribbon is set and not elasticized.

When the retaining element ribbon 232 is attached to the first side wall 102 by heat sealing, the heat sealing can be performed at a rate such that the EPDM layer is not allowed to shrink as it is being held under tension. However, the heat-sealing temperature can be sufficient to bond one of the EVA layers to the side wall 102 as shown in FIG. 6. The heat-sealing temperature can be greater than the activation temperature.

Referring to FIG. 9, the bag assembly 200 can be cut to define a bag. A sealing device has been used to make a first cut to define a first seam 106 on a first bag 240 and a second seam 108 on a second bag 241. The sealing device may include a seal wire, a sever seal, or even a bar seal in accordance with the known continuous production bag manufacturing techniques. The bag assembly 200 with the retainer element ribbon 232 applied thereto can be moved to register the sealing device at a predetermined location from the second seam 108 of the second bag 241 by moving with respect to the sealing device in the assembly direction 222 substantially parallel to the X-axis 130 of the bag. The sealing device has been used to make a second cut to form the first seam 106 of the second bag 241 thereby defining the second bag. The first bag 240 has been made in a similar fashion.

The first bag 240 is shown with the elastic ribbon 232 cut such that it defines a retaining element 120 which is attached to the first side wall 102 along the entire width of the bag 240. The retaining element 120 has been activated such that it is elasticized to provide an elastic open top end 112 for the first bag 240.

To activate the retaining strip 120, the bag 240 can be placed in a 140° F. or greater environment to provide maximum elasticity and shrinkage. The temperature can be varied with changes in the elastomeric film.

Referring to FIGS. 2, 5 and 8, in the unattached areas 152, 154 where the retaining element 120 is not attached to the side wall 102, the EPDM layer 172 can shrink and cause the EVA layers 170, 174 to shrink. Thus, the unattached areas 152, 154 of the retaining element 120 can become shorter. In the attached area 150 where the retaining tape 120 is attached to the side wall 102, the resistance provided by the side wall 102 prevents the EPDM layer 172 from shrinking. Instead, the attached area 150 will pucker as shown in FIGS. 5 and 7 to provide a shirred appearance. Thus, the attached area 150 becomes shorter along the X axis 130 by puckering (i.e. forming a serpentine path) as shown in FIGS. 5 and 7. However, the attached area 150 is actually the same length before and after activation of the elastic retaining element 120.

Referring to FIG. 9, the activation of the second bag can occur after the second bag has been packaged in a carton, for example. After the plastic bags have been manufactured and packaged, the package can be subjected to the activation temperature in order to activate the EPDM layer 172 of each bag 100.

Referring to FIGS. 10 and 11, another embodiment of an elastic top bag 300 is shown. The bag 300 includes first and second side walls 302, 304 which may be joined by first and second seams 306, 308, a closed bottom end 310, and an open top end 312 to thereby define a compartment 314. A pair of activatable elastic strip retaining elements 320, 321 is attached to the inside of the first and second sidewalls 302, 304, respectively, within the compartment 314. The retaining strips 320, 321 can be similar to the retaining strip 120 of the bag 100 shown in FIG. 1.

Referring to FIG. 11, the retaining strips 320, 321 have been activated to provide an elastic top for the bag 300.

Figure 12:
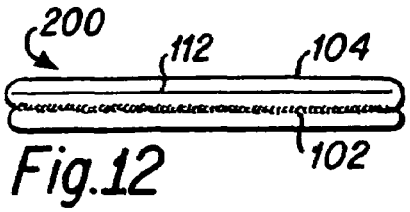
FIG. 12 is a top view of the elastic top bag of FIG. 1.

Referring to FIG. 12, the top open end 112 of the bag 100 of FIG. 1 is shown. The first and second side walls 102, 104 are generally planar.

Figure 13:
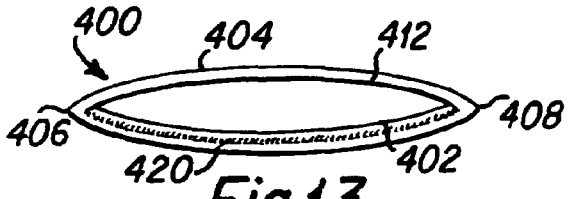
FIG. 13 is a top view of another embodiment of an elastic top bag according to the present invention.

Referring to FIG. 13, another embodiment of a bag 400 having an elastic top is shown. The bag 400 includes first and second side walls 402, 404 which may be joined together at first and second seams 406, 408, a closed bottom end, and an open top end 412. A retaining element 420 similar to the retaining element 120 of the bag 100 of FIG. 1 is provided. The first and second sidewalls 402, 404 of the bag 400 of FIG. 13 are curved to present a generally convex outer surface, thereby defining a generally elliptical open top end 412.

Figure 14:
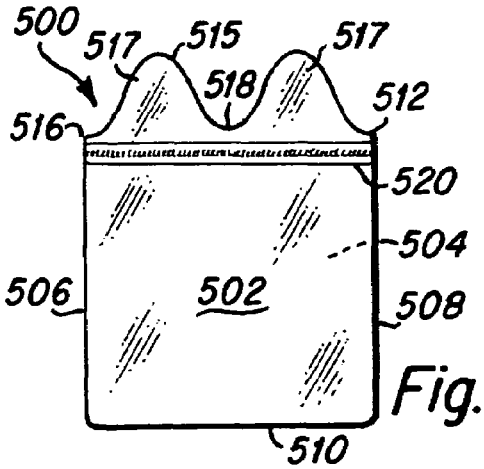
FIG. 14 is an elevational view of another embodiment of an elastic top bag in accordance with the present invention having a tie flap portion.

Referring to FIG. 14, another embodiment of a bag 500 having an elastic top is shown. The bag 500 of FIG. 14 is a tie flap bag. The bag 500 includes first and second side walls 502, 504 joined at first and second seams 506, 508, a closed bottom end 510, and an open top end 512. Each side wall 502, 504 includes a flap portion 515 extending from an upper end 516 of the side wall 502, 504. The flap portion 515 can include a pair of ears 517 separated by a recess 518. A retaining element 520 similar to the retaining element of the bag 100 of FIG. 1 can be provided. The retaining element 520 can be attached to the first side wall 502.

The ears 517 of the flap portions 515 can be knotted together to provide a closing mechanism to close the open top end 512. The tie flap ears 517 can be tied together after the bag 500 is filled with refuse for convenient closing of the top end 512 for disposal thereof.

Figure 15:
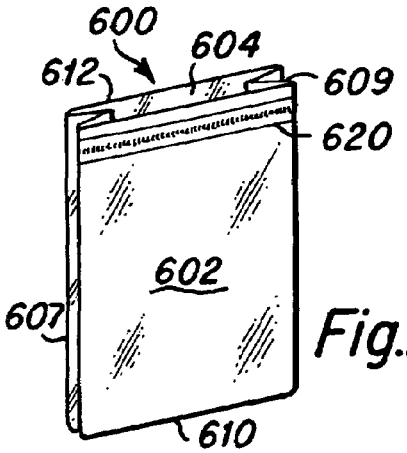
FIG. 15 is a perspective view of another embodiment of the present invention in the form of a gusseted bag having an elastic retaining element attached thereto.

Referring to FIG. 15, another embodiment of an elastic top bag 600 is shown. The bag 600 of FIG. 15 is a gusseted bag. The bag 600 includes first and second sidewalls 602, 604 which are joined together by a pair of gussets 607, 609. The bag 600 includes a closed bottom end 610 and an open top end 612. A retaining element 620 similar to the retaining element 120 of FIG. 1 can be applied to the first side wall 602.

Figure 16:
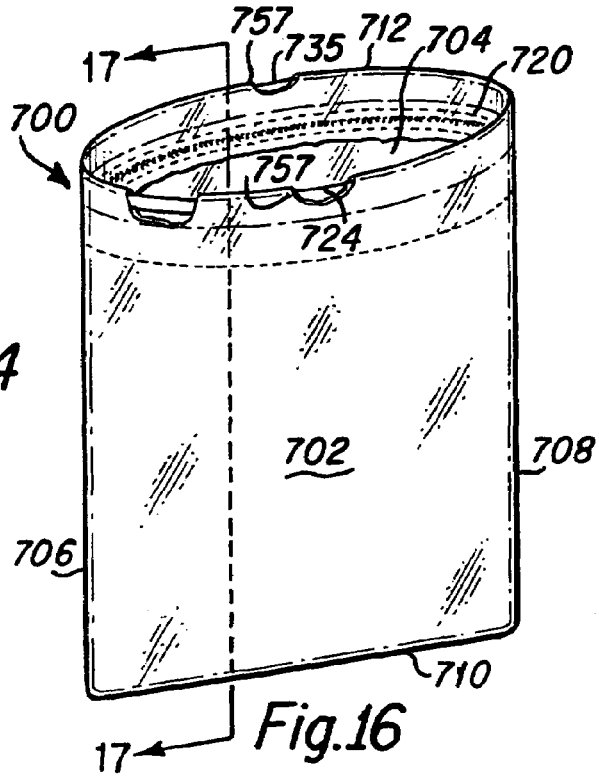
FIG. 16 is a perspective view of another embodiment of the present invention in the form of a draw tape bag having an elastic retaining element attached thereto.

Referring to FIG. 16, another embodiment of an elastic top bag 700 is shown. The bag 700 of FIG. 16 is a draw tape bag. The bag 700 includes first and second sidewalls 702, 704 which may be joined together by a pair of seams 706, 708. The bag 700 includes a closed bottom end 710 and an open top end 712. A retaining element 720 similar to the retaining element 120 of FIG. 1 may be attached to the inside of the second side wall 704.

Figure 17:
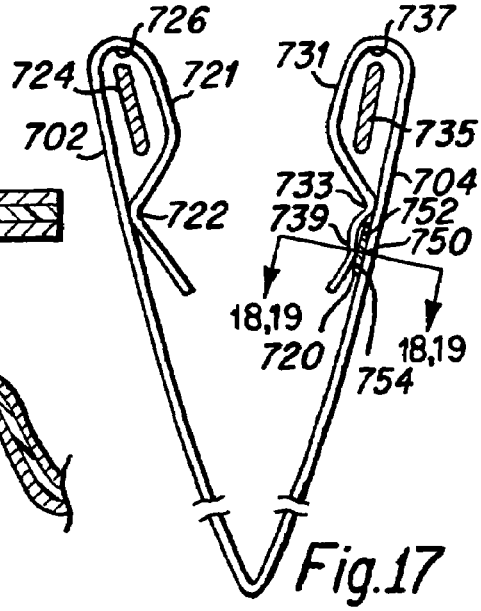
FIG. 17 is a cross-sectional view taken along the line 17-17 of FIG. 16.

Referring to FIG. 17, the first side wall 702 can include a hem flap 721. The hem flap 721 is attached to the first side wall 702 at a first hem seal 722. A first draw tape 724 is located in a first hem 726 created by the first side wall 702, the hem flap 721, and the first hem seal 722.

The second side wall 704 can include a hem flap 731. The hem flap 731 is attached to the side wall 704 at a second hem seal 733. A second draw tape 735 is located in a second hem 737 created by the second side wall 704, the hem flap 731, and the second hem seal 733. The retaining element 720 in the form of an elastic strip may be located below the second hem seal 733 and may be disposed between the second side wall 704 and the hem flap 731. The bag 100 also includes a third hem seal 739.

The third hem seal 739 can be operable to define an attached region 750 of the elastic strip 720 which is heat sealed to the second side wall 704, extending the full width of the bag 700. The third hem seal 739 continuously attaches approximately one third of the retaining strip 720 to the second side wall 704 and to the hem flap 731

The remaining portions of the retaining tape 720 is not attached to the side wall 704 or to the hem flap 731. Specifically, a first unattached region 752 is located above the attached region 750. In addition, a second unattached region 754 is located below the attached region 750.

Referring to FIG. 16, each side wall 702, 704 can include a notch 757 for allowing access to the draw tapes 724, 735, respectively. The draw tapes 724, 735 can be operated to constrict the open top end 712 to provide a closing mechanism therefor.

In accordance with an alternate embodiment, the retaining tape/elastic strip 720 can be attached to the bag between the first side wall 702 and the hem flap 721 at the first hem seal 722. This option reduces production costs by obviating the need for the additional length of hem flap material as seen in hem flap portion 731 and the third hem seal 739.

Figure 18:
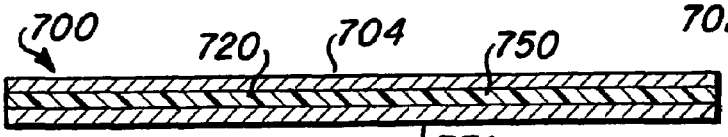
FIG. 18 is a cross-sectional view taken along the line 18-18 of FIG. 17 with the elastic strip in a deadened condition.
Figure 19:
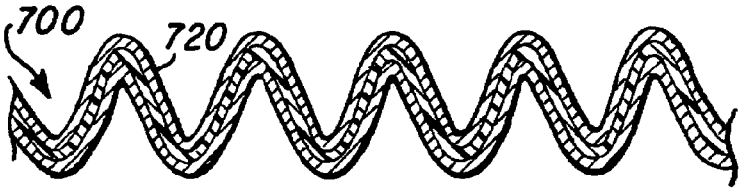
FIG. 19 is a cross-sectional view taken along the line 19-19 of FIG. 17 with the elastic strip in an activated condition.

Referring to FIG. 18, the bag 700 is shown with the retaining element 720 being in a deadened condition such that the retaining element is set. The attached region 750 of the retaining element 720 is disposed between the second side wall 704 and the hem flap 731. Referring to FIG. 19, the bag 700 is shown with the retaining element 720 being in an activated condition such that it is elastic.

In other embodiments, the retaining element of the present invention can be used in the production of a shower cap type product which can be used as a convenient elasticized article for covering food on a plate or in a bowl.

The heat shrinkable elastic can be sealed to any flexible film to create a shirred elastic band to secure the film around a second object. This could be applied to products such as diapers, hairnets, shower caps, bags, wraps, or a Quick Cover type product (Quick Cover is a trademark of S. C. Johnson & Sons). It may also be applied to the packaging of products and industrial uses wherein conventionally heated (such as hot air) shrink films are employed.

Low crystallinity chain-entangled polyethylene copolymers, for example, can be used to make the retaining tape. These elastomers have chain-entanglements and/or crystalline regions which behave as crosslinks. Suitable materials include elastomers, such as EMA (ethylene methyl acrylate), EVA (ethylene vinyl acetate), ESI (Dow Index ethylene-styrene interpolymers), ionomers, and grades of ULDPE (ultra low density polyethylene) below 0.90 g/cc, more preferably around 0.885 g/cc, for example.

The retaining tape can comprise an appropriate carbon black compound with the selected elastomer to allow for microwave activation of the retaining tape. Microwave activation can greatly reduce energy costs and simplify activation of the retaining tape.

A process for extruding and setting a suitable elastomer for use in the retaining strip can include extruding the elastic as a film by a blown film process or a casting process, for example. The web of film can be cut into a tape having a predetermined size, for example 1-1.25 inch wide. The tape can be stretched by being sent through differential nip rollers, set at a ratio of approximately 5:1, for example, to stretch the elastic according to the differential nip roller ratio, in the illustrative case five times. In this manner the polymer chains can be oriented and stretched out, or set. The stretching process can be conducted at room temperature.

After the elastic has been stretched, it experiences some recovery. The elastic retains a portion of the maximum stretched length, approximately about 50% to about 80%, for example, to provide the amount of set. The tape can then be activated by subsequent activation techniques wherein a substantial portion of the set can be recovered such that the elastic shrinks by about 40-50%. In the case of elastic being stretched five times the original size, the retained set can be approximately 2.5 to 4 times the original length.

Methods for activating the elastomeric film of the retaining element include conduction heating in a batch or continuous oven, convection heating by convective airflow, microwave activation, infra red (IR) activation, and activation by solvent application, for example. Methods of heat transfer include conduction, convection, and radiation. Conduction usually involves the transfer of energy through a solid. Convection usually involves the use of a gas or liquid (in general a fluid) and is also influenced by the laws of fluid mechanics. Lastly, radiation involves heat transfer through electromagnetic waves or photons.

As discussed previously, heating the retaining element is one suitable activation method. The application of heat to the elastic can cause the polymer chains to coil which results in the macroscopic shrinkage of the elastic tape. Heat can be applied to the elastic to cause shrinkage in a multitude of ways including use of conduction heating in a continuous oven or a batch oven for cartons/cases and convection (forced air) heating of the bags, for example.

A continuous oven usually includes an inlet, an outlet, and a heating zone disposed therebetween. A conveyor system can be provided for transporting items into the inlet, through the heating zone, and out the outlet. The oven can include other zones which cool the item, draw out gas and smoke, etc. The continuous oven method offers an advantage from a processing aspect in that, with efficient heat distribution, there is the ability to manufacture bags under substantially uniform thermal conditions.

Using a continuous oven, a steady state process can be provided wherein inactivated bags can be inserted into the oven where they can be activated. A plurality of bags disposed in a carton can be placed in a continuous oven at a predetermined temperature, such as, between about 150° F. and about 190° F. for example, for a predetermined residence time, such as about 3.6 hours per carton at a temperature of about 190° F., for example. The parameters such as the time and temperature can vary.

Convection heating can employ heated forced air to warm the retaining element. Unlike a continuous oven or a batch oven, warm air is blown directly onto the retaining element through slots or nozzles. Convection heating offers a short travel path for the heated air or gas which leads to higher heat transfer rates and hence faster processing rates. Convective heating can be combined with conventional ovens, microwave ovens, and/or infrared (IR) systems with the movement of air facilitating the distribution of heat.

For convection heating, high velocity heated air can be blown directly over individual bags or stacks of bags. The heat used to warm the air can be generated by a number of different sources such as heating coils, gas, exhausted hot air drawn from a piece of machinery, etc. The heat can be directed at the top of the bag where the heat activated elastomeric film is situated.

In one embodiment, a plurality of bags each with an unactivated elastic retaining element can be disposed in a carton. The bottom flap of the carton can remain unsealed to allow for the blowing of high velocity hot air into the carton.

In another method a stack of bags can be pinched such that all but a top portion of the bag, the upper 2 inches, for example, are retained. Jets of hot air coming from different directions can be directed at the top portions of the bags. To provide a more uniform activation of the respective elastic tapes, the stack of bags can be suspended by the closed bottom ends such that the open upper portion of the bags is disposed below the closed ends.

In other embodiments, the bags can be disposed in different orientations for convection heating to improve the uniformity of the heating. In other embodiments, the velocity profile of the heated air/gas can vary.

Another method of activation useful in connection with the present invention is with the use of an IR system. IR heating is based on absorption of waves in the infrared range. The IR method uses electromagnetic waves for heating an object.

An IR source can be finely adjusted to emit radiation in a specific wavelength range where one material will absorb the energy but another material will not. In a situation where two different materials exist, it can be possible to selectively heat one material while not heating another by tuning a radiation source to give off a majority of its wavelengths in a specified range. The emitter can be tuned to give off radiation in the range where the material desired to be heated can absorb a maximum amount of energy while the other material absorbs a minimal amount of, or no, energy.

This phenomenon is especially advantageous when one wants to heat one material while keeping the other material cool. The IR method can provide a very intense and short blast of heat, which is also useful when one wants to evenly warm one surface while keeping other materials and surfaces unheated. The IR heating can be combined with convection heating, for example.

With this activation method, infrared radiation can be used to heat up the elastomeric material while not heating the remainder of the bag. Such heating is possible because the elastomeric material can absorb radiation in wavelength ranges which are different from the wavelength ranges of the other material(s) of the bag, for example polyethylene. A source can be selected to emit radiation in a specified range of wavelengths where the elastomeric material can absorb the radiation and the polyethylene will not.

A microwave oven can be used to drastically improve processing time and cost of operation. An industrial microwave oven typically includes three main components: an oven cavity where objects can be bombarded with microwaves, a magnetron which produces the microwaves, and a wave guide which transfers microwaves to the oven cavity. A continuous microwave oven typically includes a vestibule which can act to trap all non-absorbed microwave energy so that radiation is prevented from escaping into the surroundings.

By making the retaining tape receptive to microwaves, the tape alone can be heated while avoiding heating the relatively larger mass of plastic material comprising the remainder of the bag, typically polyethylene. Microwave activation allows for relatively shorter residence times during processing than either conduction or convection heating and allows for varying production volume with only slight processing modifications.

Microwaves induce heat by being absorbed by the substrate and causing molecules to vibrate. The positive and negative elements in the molecules align themselves respectfully to the negative and positive field of the wave. Since the wave is constantly varying between the positive and negative field the particles move back and forth rubbing into each other. The friction from the vibrations in turn causes heat.

Electromagnetic radiation in the form of microwaves can be used to heat the elastic where microwave receptors are added to the elastic material. Microwaves can heat materials through the dielectric properties of the material. Dispersing a conducting phase into a non-conducting phase can cause other heating phenomena, called interfacial or Maxwell-Wagner heating, which can be caused by the build up of charges at the interfacial regions of the conducting and non-conducting phases. Alternatively, since the field is electromagnetic in nature, materials that exhibit magnetic permittivity losses can be heated, as well.

There are materials well known in the art that may be added to an elastomer to allow for microwave heating. Conductive carbon black is one such material. Conductive carbon black masterbatches are available commercially from many compounders, such as Ampacet, A. Schulman, and Modern Dispersions Inc, among others. The carbon black masterbatches can have high loadings of carbon particles, around about 30% to about 45% by weight, for example.

A retaining element having a construction wherein the carbon black masterbatch is included at 100% concentration as a thin core layer of a three layer coextruded film can be provided. The two outer skin layers can contain the elastomeric material detailed previously. The layer ratio of this construction can be the first outer elastomer layer being about 45%, the second outer elastomer layer being about 45%, and the core carbon black layer being about 10%. In other embodiments, the core layer can have a different ratio, either higher or lower. Such a tape can be elastomeric, heat sealable to the bag, and microwave heatable for activation. The sealability of the elastomer provides a mechanism by which it can be attached to other articles. In other embodiments, the retaining element can have other constructions with the number of layers being different.

In one embodiment, the carbon black retaining element can be attached to a bag by being sealed thereto to define an attached region and at least one unattached region. The retaining element can extend along the entire width of the bag, extending from the first seam to the second seam of the bag. Each bag can be about 24 inches wide, for example. The carbon black retaining element can be attached to the bag in an unactivated condition. A plurality of such bags can be made and grouped into one or more sets of bags. Each set of bags can be placed in a carton for storage thereof.

The cartons can be placed in any FCC compliant multimode continuous microwave, for example. A combination of a power setting of about 20 kW to about 30 kW and a residence time of about 60 seconds to about 90 seconds can be used for activating the retaining element to cause the bags to shrink from their original width of 24 inches to an averaged width of about 16 inches. Operating the microwave at a power setting of about 22 kW to about 25 kW can help to eliminate excessive melting of the carbon black elastic construction. Carbon black can have an exponential heating curve such that it tends to heat more readily under microwave energy as the temperature of the carbon black is increased.

Another material that can be included in the retaining element for activation by microwave heating is an iron oxide such as the ferrite magnetite, $Fe_3O_4$, for example.

Ferrites are iron oxides that may contain other metal oxides and have ferromagnetic properties, for example magnetite ($Fe_3O_4$) is a ferrite. Ferrites can interact with the magnetic component of microwave energy. The magnetic properties of ferrites arise from the dipole moments of the unpaired spins of the 3d electrons in metals such as iron, manganese, nickel, cobalt, etc. These magnetic dipoles arrange themselves in magnetic domains made of many atoms with their dipoles aligned in the same direction. Thus each domain has an overall direction or orientation. In a given small amount of material there can be many domains each pointing in different directions. Where this random domain orientation exists, such as with the ferrite material, for example, the domains tend to cancel each other with no macroscopic magnetic behavior being observed. However, when a magnetic field is applied, the domains that are more or less aligned with the magnetic field can tend to grow at the expense of unfavorably aligned domains thus increasing the overall material's alignment with the magnetic field. This change results in domain wall movement which requires energy, dissipated as heat. When microwave energy (which is a rapidly oscillating electromagnetic wave) is incident upon a ferrite, the domains can tend to grow and shrink with each oscillation so as to align with the field. This rapid domain movement results in energy dissipation, magnetic lossy behavior, and heat generation.

At elevated temperatures the domain structure tends to break down due to the thermal agitation of each dipole. Thus the material transitions at higher temperatures from an ordered domain structure to a randomly oriented collection of magnetic dipoles. The transition is from ferromagnetic behavior to paramagnetic behavior. After such a transition, the domain structure no longer exists and the individual magnetic dipoles can become very compliant to magnetic fields such that the ferrite no longer exhibits lossy behavior in the microwave field and it consequently stops heating. The temperature at which this transition occurs is called the "Curie temperature." The transition can be gradual or quite abrupt over a large or short range of temperatures. Thus the Curie temperature can be a temperature range over which the ferromagnetic properties decline.

The Curie temperature can be controlled by the composition of the ferrite, such as by blending the iron oxide with other metal oxides such as nickel, manganese, zinc, etc. in a predetermined amount, for example.

In addition to this ability to "shut off," ferrites can have a logarithmic heating curve with increases in temperature (i.e., the ferrites' heating rate decreases as the temperature increases), as opposed to an exponential growth, thereby facilitating heating control and allowing for greater tolerances and operating ranges in a continuous production setting.

Suitable ferrite powdered materials are available from Ceramic Powders Inc. of Joliet, Ill.

The ferrite material can preferably have a Curie temperature between about 100° C. and about 110° C. This temperature is sufficiently low to prevent melting of the polyethylene bag film, but high enough to cause shrinkage of the elastic.

The $Fe_3O_4$ iron oxide can be blended into a polymer resin to create a masterbatch that can in turn be blended with the elastomeric materials to render them heatable. The iron oxide can be compounded with an elastomeric resin at about 25% by weight loading to allow for microwave heating of the material. The iron oxide $Fe_3O_4$ can exhibit magnetic loss characterized by its magnetic permittivity which can be analogous to dielectric loss.

Bentonite clays may also be compounded with a polymer as a masterbatch. Bentonite is also known as montmorillonite and can have a chemical formula $Na_2O.2MgO.5Al_2O_3.24SiO_2.(6+n)H_2O$. Bentonite can contain varying amounts of alkali metal oxides such as $Na_2O$ and $K_2O$ and alkaline earth oxides such as CaO and MgO. The bentonite crystal structure contains typically 5% bound water by weight but may also absorb additional water. This water can be heatable by microwave energy.

A bentonite masterbatch can be blended into a polymer at a predetermined percentage, between about 30% and about 40% bentonite material by weight, for example, to render the material microwave heatable yet not hinder elasticity or sealability. The carrier resin of the masterbatch can be an elastomeric material so as to limit the impact on elastic properties.

Yet a further material which can be blended with an elastomeric material to allow microwave heating is an ECO (ethylene carbon monoxide copolymer), such as is commercially available from Dow as Covelle films or from DuPont as Elvaloy resins, for example. The oxygen molecule bound to the carbon in the polymer backbone can create a dipole moment which is heatable by microwave energy. Such an ECO is disclosed in U.S. Pat. No. 4,600,614, which is incorporated herein in its entirety by this reference. The ECO can be blended with an elastomeric material to provide microwave heatability to the construction without adversely affecting elasticity or sealability. The ECO-elastomer material can have a single layer or multi-layer construction.

In other embodiments, the microwave can have a number of different modes. The microwave can be cycled. The bags can be placed directly in the wave guide to subject the retaining elements to a tremendously intense microwave field.

Alternatively, a solvent can be applied to the elastic retaining strip to cause chain coiling for activating the strip. The solvent can have predetermined solubility parameter such that when the solvent is delivered to the retaining element, the elastic can shrink. Suitable solvents for activating the shape recoverable elastomers described above include but are not limited to hexane, heptane, xylene, toluene, chloroform, etc. These solvents have a solubility parameter such that they do not dissolve the shape recoverable polymer.

In other embodiments, a combination of convection, conduction and/or radiation systems can be provided.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments would become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method for manufacturing a bag comprising:

providing a first side wall;

providing a second side wall, the second side wall joined to the first side wall to define a first side end, a second side end, a closed bottom end and an open top end;

providing a retaining element having a length and width, the retaining element comprising an activatable elastic material, having a first condition wherein the retaining element is set and a second condition wherein the retaining element is urged to shrink a predetermined amount, the material is changing from the first condition to the second condition upon being activated;

attaching a portion of the width of the retaining element in the first condition along its entire length continuously to one of the first and second side walls adjacent the top end such that the retaining element extends longitudinally between the first and second side end a predetermined length to thereby define an attached portion and an unattached portion; and activating the retaining element to shrink the width of the side wall and thereby reducing the size of the open end of the bag to provide a shirred appearance to the bag.

2. The method according to claim 1 wherein the first and second side walls are integral with each other and are dispensed from a continuous web of plastic sheet material retaining element.

3. The method according to claim 1 wherein the first side wall and the second side wall are part of a bag assembly, the bag assembly being dispensed to dispense the first and second side walls, the method further comprising:

segmenting the bag assembly to define the first and second side walls and to define a first side end and a second side end of the bag.

4. The method according to claim 3 wherein the retaining element extends entirely between the first and second side ends.

5. The method according to claim 4 wherein the retaining element is dispensed from a retaining element ribbon.

6. The method according to claim 1 wherein the material of the retaining element is activated upon being heated to an activation temperature.

7. The method according to claim 6 wherein the retaining element is activated by conduction heating.

8. The method according to claim 7 wherein the conduction heating occurs by disposing the bag in a continuous oven at a predetermined temperature for a predetermined time.

9. The method according to claim 7 wherein the conduction heating occurs by disposing the bag in a batch oven at a predetermined temperature for a predetermined time.

10. The method according to claim 6 wherein the retaining element is activated by convection heating.

11. The method according to claim 6 wherein the retaining element is activated by subjecting the retaining element to radiation.

12. The method according to claim 11 wherein the retaining element is activated by microwaving.

13. The method according to claim 6 wherein the retaining element is activated by applying a solvent thereto.

14. The method according to claim 6 wherein the retaining element is activated by a combination of at least any two of the following: conduction heating, convection heating, subjecting the retaining element to radiation, and applying a solvent thereto.

15. The method according to claim 1 further comprising:

placing the bag in a carton.

16. The method according to claim 15 wherein the bag is placed in the carton before activating the retaining element.

* * * * *